United States Patent [19]

Shamlian

[11] 3,978,537

[45] Sept. 7, 1976

[54] SWIM FIN INCLUDING MEANS FOR MAINTAINING FOOT AND LEG IN FIXED RELATIONSHIP

[75] Inventor: Ralph B. Shamlian, San Francisco, Calif.

[73] Assignee: Farallon Industries, Inc., Belmont, Calif.

[22] Filed: Jan. 14, 1975

[21] Appl. No.: 540,908

[52] U.S. Cl. ..... 9/309

[51] Int. Cl.[2] ..... A63B 31/12

[58] Field of Search ..... 9/301, 303, 304, 305, 9/306, 309

[56] References Cited

UNITED STATES PATENTS

| | | | |
|---|---|---|---|
| 1,114,466 | 10/1914 | Goodenberger | 9/303 |
| 2,903,719 | 9/1959 | Wozencraft | 9/309 |
| 3,239,857 | 3/1966 | Gwynne | 9/309 |

FOREIGN PATENTS OR APPLICATIONS

| | | | |
|---|---|---|---|
| 1,199,517 | 7/1970 | United Kingdom | 9/309 |

*Primary Examiner*—Trygve M. Blix
*Assistant Examiner*—Sherman D. Basinger
*Attorney, Agent, or Firm*—Lowhurst & Aine

[57] ABSTRACT

In a swim fin, members are provided for maintaining a swimmer's foot in fixed angular relationship with respect to the swimmer's leg, particularly during a downward kick or leg extension mode. The ankle is substantially locked in one position, and stress that would be placed on the ankle in the utilization of a prior swim fin is transmitted to the leg. In one embodiment, a rigid member extends from the foot-receiving portion of the fin to engage the swimmer's lower shin. Straps maintain the swimmer's leg and foot in fixed relationship to the swim fin. Adjustable members may be provided for adjusting the selected, fixed angular relationship between the swimmer's foot and leg.

13 Claims, 8 Drawing Figures

SWIM FIN INCLUDING MEANS FOR MAINTAINING FOOT AND LEG IN FIXED RELATIONSHIP

BACKGROUND OF THE INVENTION

The present invention relates to foot-mounted swim fins such as are used by underwater swimmers.

DESCRIPTION OF THE PRIOR ART

The type of swim fin comprehended by the present invention comprises a foot-receiving portion and a blade extending forwardly from the foot. Such swim fins are occasionally referred to as "flippers". The foot-receiving portion may comprise either a pocket for receiving a forward portion of the foot and a heel strap or may comprise a shoelike foot receptacle. The use of swim fins enables a swimmer to increase propulsive forces created by his legs. Swim fins are useful to both surface swimmers and scuba (underwater) divers. Swim fins are of greatest significance in scuba applications since scuba divers depend primarily on their legs and feet for propulsion. Typically, a scuba diver performs the flutterkick, which is a scissor-like motion of almost outstretched legs. Reactive forces are generated in response to motions of the leg and foot against the water during most of the kick. Due to utilization of swim fins, the magnitude of reactive forces is multiplied by the fin blade as a function of its surface area. As one leg of the swimmer, and hence the blade, moves down through the water, it is the propulsive, upper surface of the blade on which reactive forces operate. Those components of reactive forces which are resolved parallel to the longitudinal axis of the body contribute to forward motion, and are defined as thrust. The reaction of the blade to the water in response to the downward, or power, kick produces forward thrust.

The motion of the lower leg in a kick is substantially arcuate. For purposes of the present description, the plane in which the arc defined by the kick lies will be referred to as the kick plane. In order to obtain maximum forward thrust for a kick of a predetermined force and a fin blade of a fixed size, it is desirable to keep the surface of the blade normal to the kick plane. This disposition of the blade allows the full surface area of the blade to be forced against the water. It is desirable to keep the blade normal to the kick plane to prevent spillage, or movement of water across rather than against the blade. Also in order to obtain the maximum forward thrust it is desirable to reduce rotation of the blade about an axis defined by the swimmer's lower leg. Thrust is reduced when a swimmer's foot wobbles on a downward kick due to strain on the ankle joint.

The force produced in response to which the propulsive reactive forces are produced are provided by the swimmer's legs. Since the swim fins are foot mounted, forces must be transmitted through the swimmer's ankles. In pushing a swim fin down with the lower leg, planar flection results. Planar flection is the rotation of the foot downwardly or away from the lower leg. The greater the amount of force provided, the greater is the amount of planar flection that can result. In other words, those parameters, e.g. blade size or force of kick, which produce desirable forward thrust also produce planar flection.

Planar flection can overextend ligaments in the leg and foot. Planar flection can also result in cramps in the ankle, arch and lower leg. The effects of planar flection are significant because the ankle joint is undeveloped and weak compared to many other parts of the body. It is well-known that even professional athletes can sprain an ankle from an act as simple as stepping off of a curb. Thus in the employment of swim fins, there is a natural tension between providing maximum forward thrust and placing maximum strain on muscles and ligaments of the ankle.

SUMMARY OF THE INVENTION

It is therefore an object of the present invention to provide a swim fin which provides for minimized planar flection in use.

It is also an object of the present invention to provide a swim fin including means for assisting a swimmer in maintaining the fin blade normal to a kick plane, whereby spillage is reduced and whereby a maximum forward force vector is produced in response to a kick.

It is a further object of the present invention to provide a swim fin of the type described in which a swimmer's ankle is substantially rigidly maintained such that his foot is maintained at a comfortable angle with respect to his lower leg and such that wobbling of the swimmer's foot due to stress on the ankle joint is reduced or eliminated.

It is also an object of the present invention to provide a swim fin of the type described in which the fixed angle between the swimmer's foot and lower leg is selectable.

It is another object of the present invention to provide a swim fin of the type described providing support to ligaments and musculature in the vicinity of the ankle.

It is yet another object of the present invention to provide a swim fin of the type described including means for enabling a swimmer to transfer energy directly from well-developed leg muscles to a fin blade directly, without coupling such forces through the ankle.

It is also a specific object of the present invention in one form to provide a swim fin of the type described which maintains a fixed angular relationship between the swimmer's foot and lower leg during a downward kick, or leg extension and yet permits the swimmer to stand erectly while wearing the swim fin.

Briefly stated, in accordance with the present invention, there is provided a foot-mounted swim fin including bracing means extending from a foot-receiving portion for maintaining the foot at a predetermined angle with respect to the leg. In one form a rigid extension projects upwardly from the foot-receiving portion for engagement against the forward portion of the lower leg. The lower leg and heel are strapped against the foot-receiving portion and extension. The lower leg and foot are rigidly mounted to the swim fin. Planar flection is prevented.

BRIEF DESCRIPTION OF THE DRAWINGS

The means by which the foregoing objects and features of novelty are achieved are pointed out with particularity in the claims forming the concluding portion of the specification. The invention, both as to its organization and manner of operation, may be further understood by reference to the following drawings.

Of the drawings.

DESCRIPTION OF THE PREFERRED EMBODIMENTS

Figure 1:
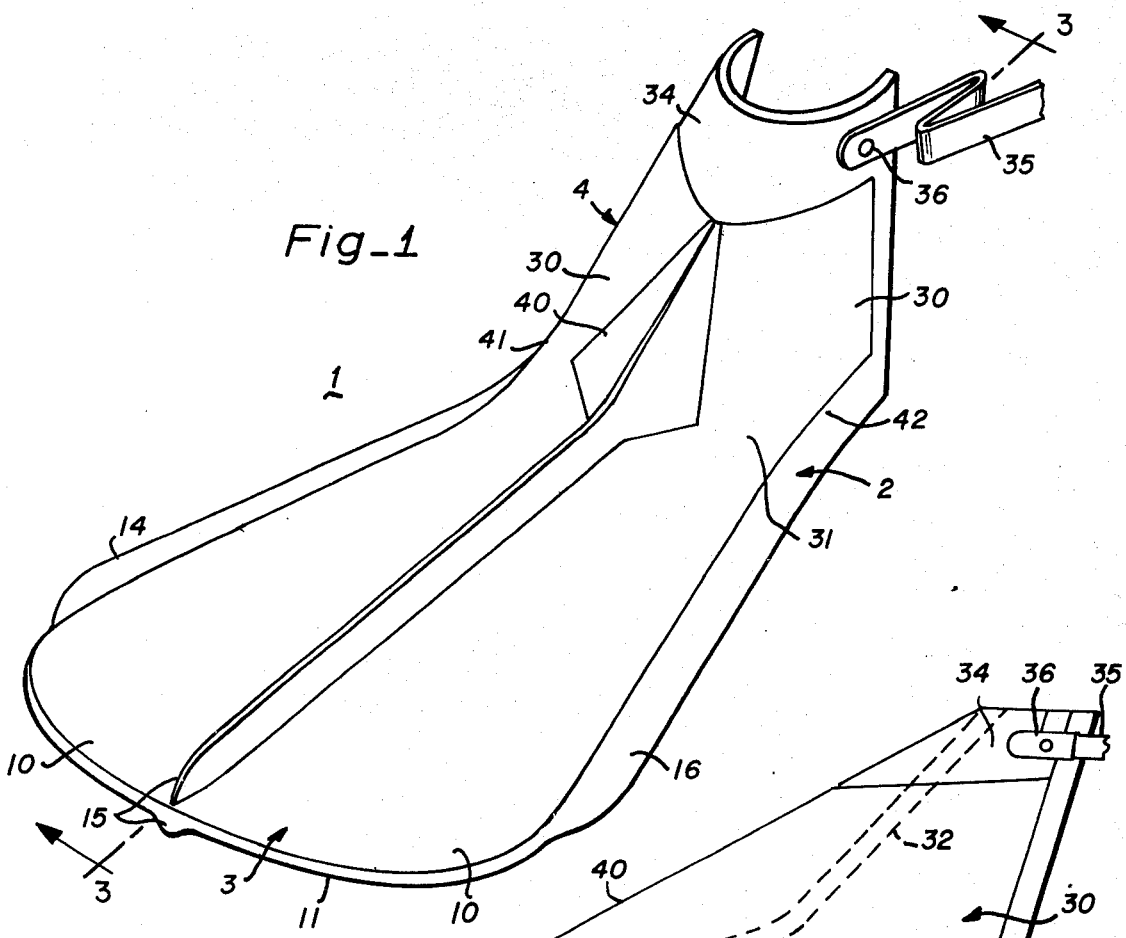
FIG. 1 is a perspective view of a swim fin constructed in accordance with the present invention.
Figure 2:
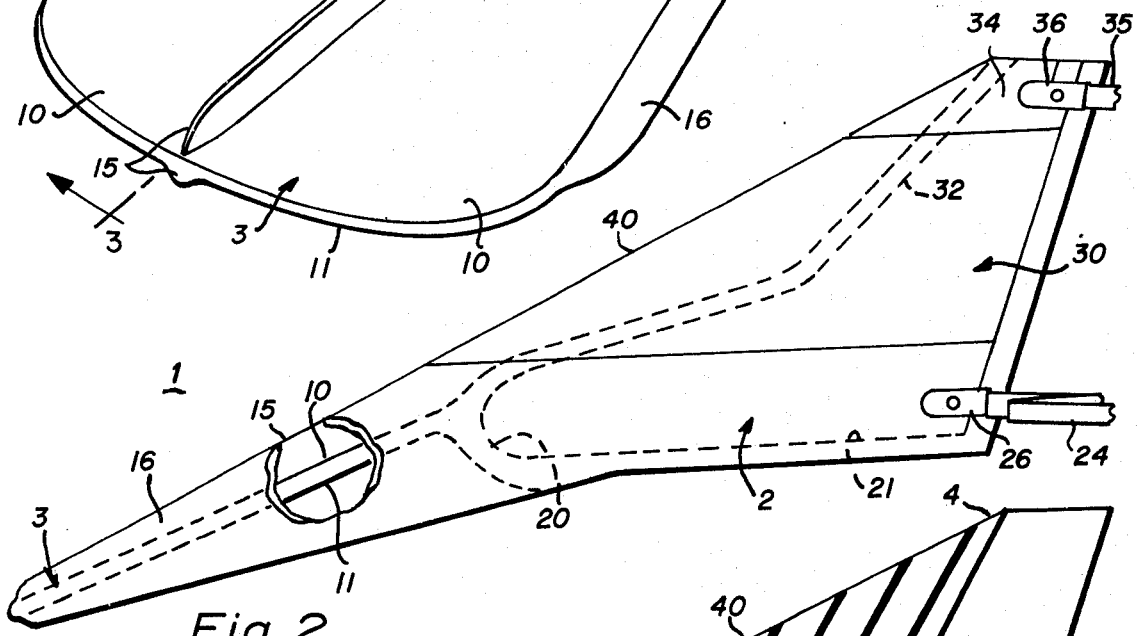
FIG. 2 is a side elevation of the embodiment of FIG. 1, partially broken away to illustrate further the blade of the swim fin.
Figure 3:
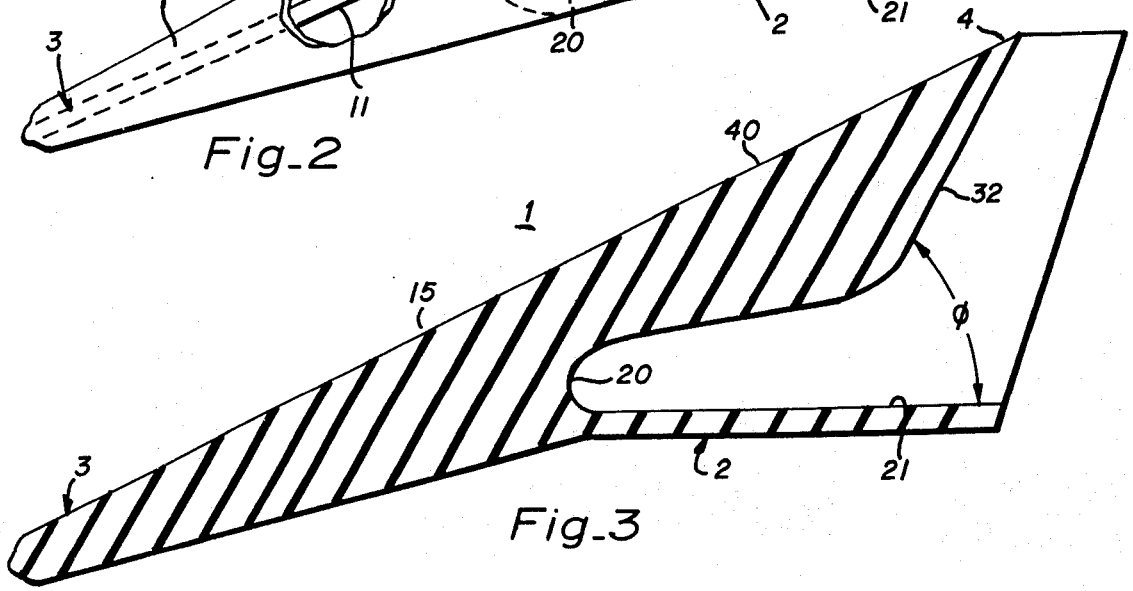
FIG. 3 is a cross-sectional view taken along lines III—III of FIG. 1.

Referring now to FIGS. 1, 2 and 3, there is illustrated a first embodiment of a swim fin 1 constructed in accordance with the present invention. FIG. 1 is a perspective view of the swim fin 1, FIG. 2 is a side view of the swim fin 1, and FIG. 3 is a cross-sectional view taken along line III—III of FIG. 1, which line comprises the longitudinal axis of the swim fin 1. The swim fin 1 includes a foot-receiving portion 2 and a blade 3 extending longitudinally forward thereof. In accordance with the present invention, a leg-bracing portion 4 is provided extending upwardly from the foot-receiving portion 2 and cooperating therewith. As described in further detail below, the leg-bracing portion 4 in cooperation with the foot-receiving portion 2 provides for improved imparting of energy to the blade 3 and for improved response to reactive forces acting on the blade 3.

The swim fin 1 is described in greater detail referring first to the blade 3. The blade 3 has an "upper" surface 10 and a "lower" surface 11, both extending forwardly of the foot-receiving portion 2. The terms upper, lower and forward denote orientation with respect to the foot of a swimmer. FIG. 2 is partially broken away to better illustrate the surfaces 10 and 11. In use, the upper surface 10 of the blade 3 is forced against the water by the leg of a swimmer in order to produce the above-described reactive forces. The surface 10 is the propulsive surface.

Longitudinally extending dihedral ribs 14, 15 and 16 are provided formed integrally with the blade 3. The ribs 14 and 16 are spaced at lateral (perpendicular to longitudinal) sides of the blade 3, and the rib 15 is formed in the lateral center of the blade 3. The blades 14, 15 and 16 project from both the upper and lower surfaces 10 and 11 of the blade 3. The dihedral surfaces of the ribs 14, 15 and 16 provide for hydrodynamic stability of the blade 3. The ribs 14, 15 and 16 are hydrodynamically shaped to aid in maintaining the surface 10 in a disposition normal to the kick plane during each kick. The blade 3 may be a solid blade, as illustrated. Alternatively, the blade 3 may comprise any one of a number of forms of well-known vented fins.

The foot-receiving portion 2 may, as shown in the present embodiment, comprise a pocket 20 for receiving the portion of a foot forward of the ankle. The pocket 20 includes a base 21 for bearing against the sole of a foot. In other embodiments, the foot-receiving portion 2 may comprise a well-known "shoe". In the present embodiment, a heel strap 24 is provided mounted to the pocket 20 by conventional fastening means 26. The heel strap 24 is fastened around the back of a swimmer's foot in order to maintain the foot in engagement with the pocket 20.

The leg bracing portion 4 cooperates with the foot-receiving portion 2 to provide a fixed angular relationship between the foot and the leg. In the present embodiment, a wall 30 is provided rising from a junction 31 with the foot-receiving portion 2 located above the pocket 20. The wall 30 is formed extending laterally across the fin 1 and having a rearwardly directed contoured inner surface 32 (FIG. 3). The inner surface 32 is positioned for abutment against a lower leg when a foot is inserted in the pocket 20. A top portion 34 of the leg-bracing portion 4 has mounted thereto a strap 35 by means of a conventional fastener 36. The strap 35 is fastened around the lower leg of the swimmer and retained by a conventional fastener (not shown) laterally opposite the fastener 36. With the straps 24 and 35 fastened, the foot is engaged in the pocket 20, and the lower leg is maintained against the surface 32. The wall 30 is constructed to be rigidly positioned with respect to the foot-receiving portion 2. In this manner, the angular relationship of the foot to the lower leg is fixed. Stress is thus relieved from the ankle joint during propulsive kicks. Many convenient means may be used to produce a wall 30. Well-known rigid thermosetting materials could be used for example.

Swim fins are typically made of an elastomer such as natural or synthetic rubber having a durometer of between 60 and 90. In the present embodiment, the swim fin 1 is integrally molded out of one typical swim fin material. To provide sufficient structural strength for imparting sufficient rigidity to the wall 30, a bracing rib 40 is formed in the leg-bracing portion 4. The bracing rib 40 extends along the longitudinal axis of the swim fin 1 and is located in the lateral center of the leg-bracing portion 4. The bracing rib 40 extends from the rib 15 to the top portion 34. The bracing rib 40 is formed to be wide with respect to the rib 15 at the point at which it is in registration with the junction 31 and is tapered toward the top portion 34. The bracing rib 40 is preferably a dihedral rib, forming an integral rib in combination with the rib 15. Such construction of the bracing rib 40 provides for strutural integrity as well as a hydrodynamic shape. For further structural integrity and hydrodynamic design, ribs 41 and 42 may be provided extending longitudinally from the ribs 14 and 16 respectively to the lateral sides of the swim fin 1. The surface 32 in the plane of FIG. 3 (i.e., a plane tangent to the surface 32 at its laterally forward end) is canted at an angle $\phi$ selected in fabrication with respect to the base 21 which provides a comfortable fixed relationship of the lower leg to the foot, and which provides a satisfactory disposition of the blade 3 in the water during kicks. It has been found that a suitable value of $\phi$ is 65°.

For purposes of the present description, the angle $\phi$ may also be used to describe the angle between the longitudinal axis of the lower leg and the longitudinal axis of the foot.

OPERATION

Figure 4:
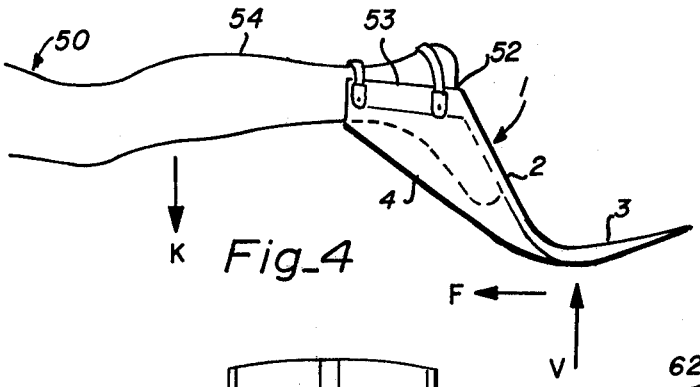
FIG. 4 is an illustration demonstrating the operation of the present invention.

Operation of the swim fin 1 is illustrated in FIG. 4, in which the same reference numerals are used to denote elements corresponding to those of FIGS. 1, 2 and 3. In FIG. 4, a swimmer's leg 50 is shown operating a swim fin 1 worn on his foot 52, ankle 53 and lower leg 54. The downstroke of the leg 50 provides a force K, which is transmitted to the swim fin 1. The blade 3 engages the water and reactive forces are produced including a reactive force vector F comprising the forward thrust vector. The vector F is resolved from a force vector V against the swim fin 1 produced in reaction to the downward kick. The force vector V must be borne by the ankle when the swimmer is wearing conventional fins. Using the swim fins of the present invention, the force vector V exerted on the foot-receiving portion 2 and the moment exerted by the blade 3 are transmitted by the leg-bracing portion 4 to the leg 50. Consequently, the well-developed musculature of the leg 50 may assist in creating propulsive force. At the same time, a minimized amount of force is transmitted to the ankle 53. Because the foot 52 is mounted rigidly with respect to the leg 54 planar flection is eliminated. Further advantages of the rigid mounting of the leg include increased propulsion since wobbling of the foot with respect to the ankle is substantially eliminated. The blade 3 is maintained perpendicular to the kick plane. Consequently, the full surface 10 of the blade 3 is presented to the water. Spillage of water across the surface 10 is greatly reduced. Additionally, rotation of the blade 3 about an axis defined by the lower leg 54 is substantially eliminated. Because force is relieved from the ankle 53, the incidence of cramps in the ankle, arch and foot is reduced. Increased efficiency in propulsion is provided.

Figure 5:
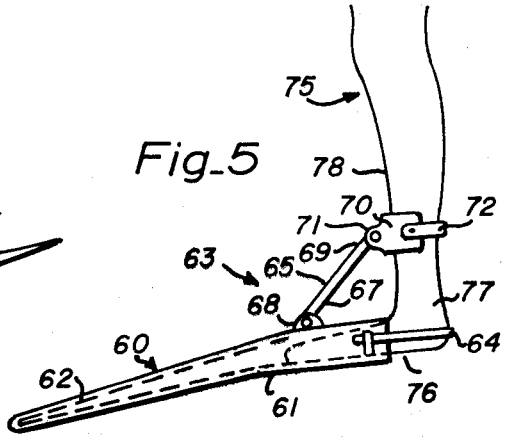
FIG. 5 is a side elevation of a further embodiment of the present invention.

FIG. 5 is an illustration of a further embodiment of the present invention. A swim fin 60 is provided for mounting on a leg 75 including a foot 76, ankle 77 and a lower leg 78. The swim fin 60 comprises a foot-receiving portion 61, a blade 62 and a leg-bracing portion 63. A conventional heel strap 64 is provided for holding a swimmer's foot in the foot-receiving portion 61. The leg-bracing portion 63 includes a rigid brace 65.

The angle $\phi$ between the foot 76 and the lower leg 78 is a function of the length of the brace 65. The brace 65 is adjustable in length so that the swimmer may select a comfortable angle $\phi$. Adjustability may be provided by any of a number of conventional, well-known means, for example by the use of a brace 65 comprising telescoping tubes.

The brace 65 has a first end 67 mounted to the foot-receiving portion 62 by mounting means 68. An opposite end 69 of the brace 65 engages a leg mount 70 at mounting means 71. The mounting means 68 and 71 include means for pivotally engaging the opposite ends of the brace 65 in order to allow for differences in the angle $\phi$ due to selection of the length of the brace 65. The leg mount 70 is curved to provide a surface abutting the lower leg 78. A leg strap 72 is utilized to maintain the leg mount 70 in engagement with the lower leg 78. When the swim fin 60 is mounted on the foot 76 the brace 65 is maintained by the foot-receiving portion 62 and leg mount 70 in a fixed angular relationship. Since the foot 76 and lower leg 78 are maintained in a fixed angular relationship, the above-described advantages are obtained. The brace 65 may be constructed from stainless steel, fiberglass or other suitable material that is sufficiently rigid to maintain an angle $\phi$ in response to a downward kick and which does not corrode in salt water.

Figure 8:
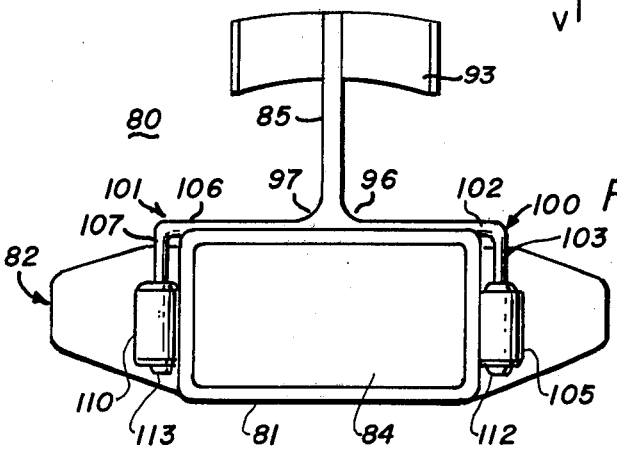
FIG. 8 is a rear elevation of the embodiment of FIG. 6.
Figure 6:
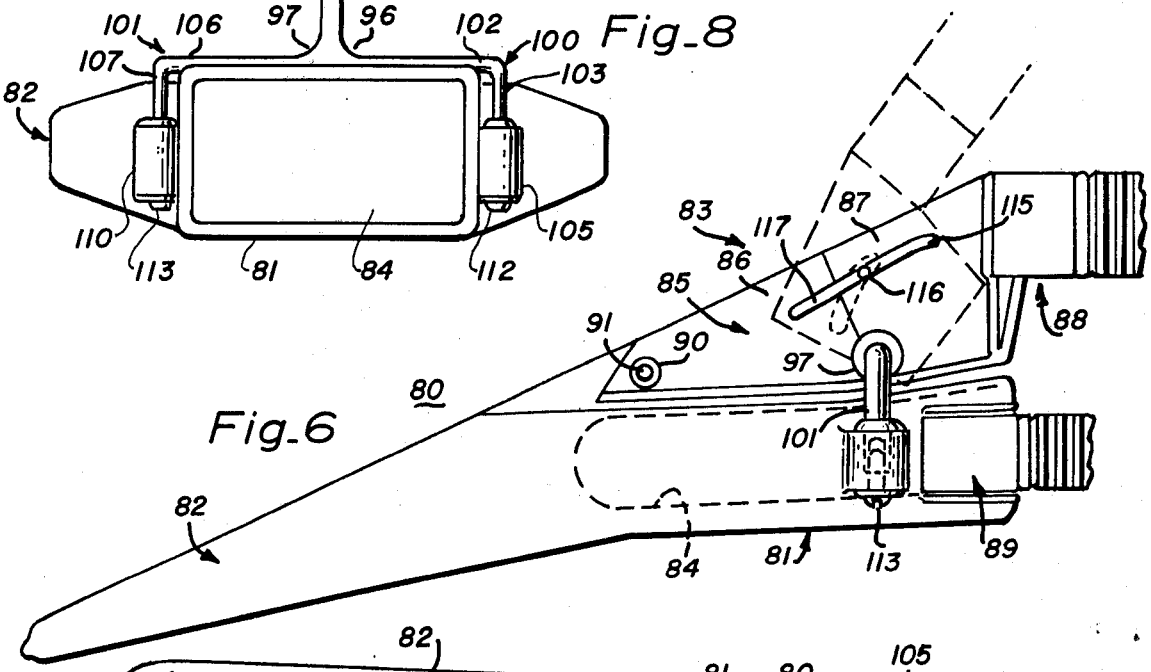
FIG. 6 is a side elevation of another embodiment of the present invention.
Figure 7:
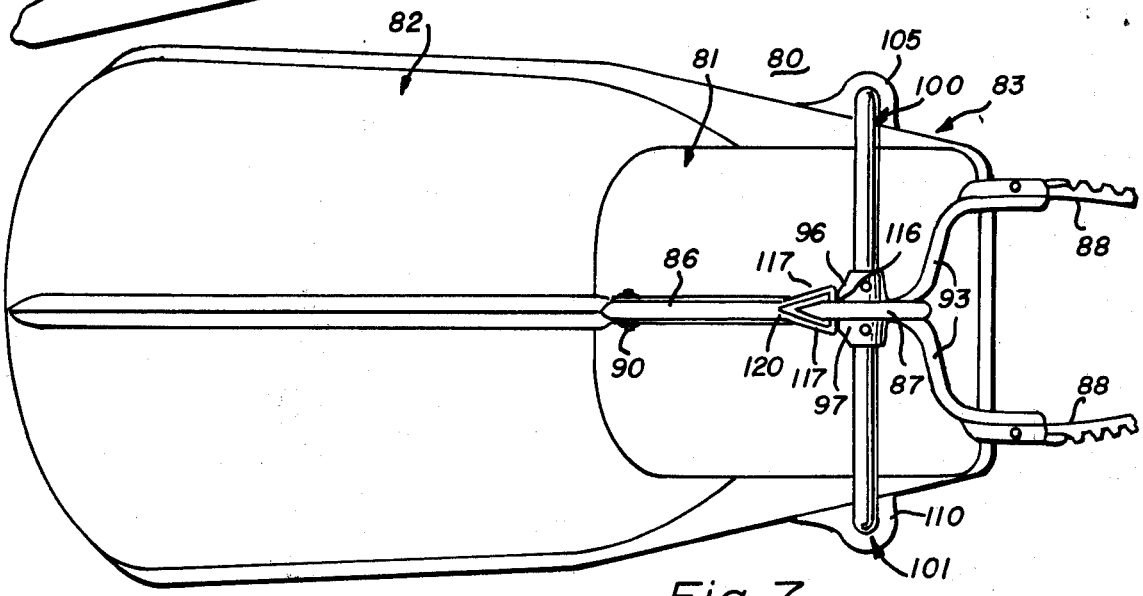
FIG. 7 is a plan view of the embodiment of FIG. 6.

FIGS. 6, 7 and 8 are side elevation, plan and rear elevation views of a further embodiment of the present invention. This embodiment provides for a selected angle $\phi$ maintained during a downward kick. Additionally, means are provided for permitting a swimmer to stand erectly while wearing the swim fins. A swim fin 80 is provided having a foot-receiving portion 81, a blade 82 and a leg-bracing portion 83. The foot-receiving portion 81 may comprise a conventional foot-receiving pocket having a base 84 for engaging the sole of a foot. The blade 82 may be similar to the blades 3 and 62 of FIGS. 1 and 3 respectively. Leg strap and fastening means 88 are heel strap and fastening means 89 are provided.

Referring to FIG. 6, the leg-bracing portion 83 includes a laterally centrally disposed bracing rib 85 comprising rib sections 86 and 87. The bracing rib 85 may be of uniform lateral thickness, and is tapered, rising vertically and rearwardly from a pivotal mounting point 90 adjacent the rear of the blade 82. The upper rear end of the bracing rib 85 supports a leg mount bracket 93 (FIGS. 7 and 8), which is positioned vertically for abutting the lower leg of a swimmer. The foot-receiving portion 81 and blade 82 are made of conventional swim fin materials. It is desirable that the bracing rib 85 be made of a well-known strong, lightweight thermoplastic.

The bracing rib 85 is mounted to the mounting point 90 by means of fastening means 91. Rearwardly of the mounting point 90, laterally opposed bosses 96 and 97 are formed on the bracing rib 85, and the rib section 87 is pivotally mounted thereon. The rib section 86 is fixed between the mounting point 90 and the bosses 96 and 97.

In order to fix the distance between the base 84 of the foot-receiving portion 81 and the leg mount 93, and hence select the angle $\phi$, means are provided for fixing the vertical relationship of the bosses 96 and 97 to the foot-receiving portion 81. As best seen in FIG. 8, first and second L-shaped supports 100 and 101 are provided. Other convenient forms of support as will be apparent from the description below may be used. The L-shaped support 100 has a horizontal leg 102 having an end received in the boss 96, and a vertical leg 103. An end of the leg 103 is received in a boss 105 extending laterally from the foot-receiving portion 81. The L-shaped support 101 has a horizontal leg 106 having an end received in the boss 97, and a vertical leg 107. An end of the vertical leg 107 is received in a boss 110 extending laterally from the foot-receiving portion 81, laterally opposed to the boss 105. The L-shaped supports 100 and 101 may conveniently be made of stainless steel tubing. To provide adjustability, the lower ends of the legs 103 and 107 are provided with inner threads. First and second screws 112 and 113 are mounted to the bosses 105 and 110 respectively for rotation therein and for mating with the threads of the legs 103 and 107 respectively. Rotation of the screws 112 and 113 adjusts the height of the supports 100 and 101 with respect to the foot-receiving portion 81. Consequently, the rib 85 rotates about the pivotal mounting point 90, and the angle $\phi$ is selected.

In order to permit a wearer to stand while wearing a swim fin 80, the rib section 87 pivots about the bosses 96 and 97. In use a typical value of $\phi$ is on the order of 65°. Such an angle $\phi$ does not permit a wearer to stand. When standing, the angle $\phi$ is approximately 90°. In use, a wearer loosens the leg strap 88. As he stands, his lower leg bears against the leg mount (or mounting bracket) 93. The leg mount 93 and the rib section 87 rotate about the bosses 96 and 97, so that the rib section 87 assumes the position shown in dotted lines in FIG. 6. To further facilitate this operation, a slot 115 is formed in the rib section 87. A pin member 116 is mounted in the slot 115 and supported by arms 117 extending from the rib section 86. A pin and slot relationship of the pin member 116 and slot 115 is provided for limiting rotation of the rib section 87 to, for example, the position shown in FIG. 6. The slot 115 is dimensioned such that on a downward kick, rotation of the rib section 86 with respect to the rib section 85 is limited such that the angle $\phi$ selected by adjustment of the legs 100 and 101 is maintained. A tapered groove 120 may be formed in the rear of the rib section 86 so that the rib section 87 may fit therein upon rotation.

Other embodiments of a swim fin may be constructed in accordance with the present invention. A higher or lower leg-bracing portion could be provided; other forms of brace members could be provided. Many modifications may be made to provide a swim fin constructed in accordance with the present invention.

What is claimed as new and desired to be secured by Letters Patent of the United States is:

1. A foot mounted swim fin adapted for fitting to the individual legs of a wearer in such a manner that the wearer is able to manipulate his or her legs independently of each other comprising in combination: a foot-receiving portion including a pocket for receiving at least the forward end, including the toes of a wearer's foot; a blade having an upper forward thrust surface extending forwardly from said foot-receiving portion and a leg-bracing portion with means for attachment to a leg extending rigidly from said foot-receiving portion at a predetermined fixed angle for preventing deflection of said foot-receiving portion relative to said leg-bracing portion when forward thrust-producing hydrodynamic forces act on said upper surface of said blade.

2. A swim fin according to claim 1 wherein said leg-bracing portion comprises a rigid wall extending rigidly upwardly from said foot-receiving portion at a predetermined fixed angle relative to said foot-receiving portion.

3. The swim fin of claim 2 in which said wall includes a longitudinally rearwardly extending curved inner surface for abutting a lower leg.

4. A swim fin according to claim 3 wherein said foot-receiving portion, said blade and said leg-bracing portion are integrally molded of an elastomeric material.

5. The swim fin of claim 4 in which said leg-bracing portion comprises a dihedral rib integrally formed with said wall, said rib having a widened portion in registration with the junction of said leg-bracing portion and said foot-receiving portion.

6. A swim fin according to claim 5 wherein said foot-receiving portion includes a base for supporting a sole of a foot and in which a said inner surface of said wall is canted such that a plane tangent to said inner surface at the longitudinally forward extent thereof forms an angle of 65° to said base.

7. A swim fin according to claim 1 in which said leg-bracing portion comprises a brace having a first end mounted to said foot-receiving portion, a leg mount mounted to a second end of said brace, whereby when a foot is inserted in said foot-receiving portion and said leg mount is fastened to a leg, the foot and the leg are maintained in a fixed angular relationship.

8. A swim fin according to claim 7 in which said brace is adjustable in length.

9. A swim fin according to claim 1 wherein said leg-bracing portion includes a longitudinally disposed bracing rib having a first end mounted adjacent the rear of said blade, said rib rising vertically and rearwardly, and further comprising a leg mount mounted to the rear of said rib and positioned vertically above the rear of said foot-receiving portion.

10. A swin fin according to claim 9 including adjusting means for adjusting the position of said leg mount with respect to said foot-receiving portion whereby the angle between a foot and a leg of a wearer is selected.

11. The swim fin of claim 10 wherein said bracing rib is pivotally mounted at a forward end thereof, and in which said adjusting means comprises means for adjusting the rotation of said bracing rib with respect to said foot-receiving portion.

12. A swim fin according to claim 11 wherein said bracing rib comprises first and second sections, said second section being rearward of said first section and being pivotally mounted with respect to said first section that said second section is rotatable with respct to said first section to permit a wearer to stand erectly while wearing said swim fin.

13. In a swim fin adapted for fitting to the individual legs of a wearer in such a manner that the wearer is able to manipulate his or her legs independently of each other and having a foot-receiving portion including a pocket for receiving at least the forward end, including the toes, of the wearer's foot and a blade having an upper surface extending from and forwardly of said pocket, the improvement comprising: a leg bracing portion extending rigidly from said foot-receiving portion, said leg-bracing portion including a surface positioned with respect to said foot-receiving portion for abutting the lower portion of a leg, whereby when a foot is mounted in said foot-receiving portion, said leg-bracing portion cooperates with said foot-receiving portion for preventing deflection of said foot-receiving portion relative to said leg-bracing portion when forward thrust-producing hydrodynamic force acts on said upper surface of said blade.

* * * * *